US005798616A

United States Patent [19]

Takehara et al.

[11] Patent Number: 5,798,616

[45] Date of Patent: Aug. 25, 1998

[54] FLUORESCENT LAMP CIRCUIT EMPLOYING BOTH A STEP-UP CHOPPER AND AN INVERTER

[75] Inventors: Takao Takehara, Iwata-gun; Masashi Norizuki, Yaizu, both of Japan

[73] Assignee: Minebea Co., Ltd., Kitasaku-gun, Japan

[21] Appl. No.: 625,233

[22] Filed: Apr. 1, 1996

[30] Foreign Application Priority Data

Apr. 6, 1995 [JP] Japan ..... 081110/1995

[51] Int. Cl.[6] ..... H05B 37/02

[52] U.S. Cl. ..... 315/247; 315/307; 315/219

[58] Field of Search ..... 315/247, 219, 315/307, DIG. 7, 224, DIG. 4, DIG. 5

[56] References Cited

U.S. PATENT DOCUMENTS

| | | | |
|---|---|---|---|
| 4,277,728 | 5/1978 | Stevens | 315/247 |
| 5,262,699 | 8/1991 | Sun et al. | 315/225 |
| 5,408,403 | 4/1995 | Nerone et al. | 315/247 |
| 5,574,336 | 11/1996 | Konopka et al. | 315/247 |

*Primary Examiner*—Robert J. Pascal
*Assistant Examiner*—Michael Shingleton
*Attorney, Agent, or Firm*—Staas & Halsey

[57] ABSTRACT

A fluorescent lamp circuit having a power-factor improving step-up chopper and an inverter to covert an output of the step-up chopper and to drive the fluorescent lamp. A switching circuit of the step-up chopper and a switching circuit of the inverter are operated by a switching element consisting of a single transistor.

4 Claims, 7 Drawing Sheets

AC
D11
REC
C2
L1
D1
L2
CT
LT
D2
Q1
R2
C1
CS
T1
NP
LB
NS
CL
FL
CD
C11
D12
R22
R21
D14
C12
Nf
D13
R13
Q1 DRIVE SIGNAL
IC1
5v
Vref
VCC
R24
R29
R16
R17
OPA2
R15
C15
R23
ZD1
D15
R27
VLIM
R28
Q11
MB2
TUM
"ON"
OPA3
R25
R26
CONTROL INPUT
TERMINAL

FLUORESCENT LAMP CIRCUIT EMPLOYING BOTH A STEP-UP CHOPPER AND AN INVERTER

BACKGROUND OF THE INVENTION 1. (Field of the Invention)

This invention relates to a high-frequency lighting apparatus for a fluorescent lamp and, more particularly, to a high power factor and a high-frequency lighting apparatus for a fluorescent lamp.

2. (Description of the Prior Art)

A circuit diagram of a high-frequency lighting apparatus used for a fluorescent lamp is shown in FIG. 9. In FIG. 9, an AC voltage of a commercial AC power source AC is rectified by a rectifier including diodes D1 to D4, an inductor LF and a capacitor CF, and the output of the rectifier is applied to a step-up chopper type sine-wave converter including a choke coil L1, a switching element Sw1, a diode D5 and a capacitor C. A voltage resonance type inverter is connected as a load to the sine-wave converter.

The step-up chopper type sine-wave converter will be simply described. To form an input current Ii in the same waveform as that of a commercial AC power source voltage ei, the voltage ei is firstly detected by resistors R1 and R2, and the detected voltages are input to a multiplier MP1. The output of the multiplier MP1 becomes a current command value Ii* having the same waveform as that of the voltage ei. The output Ii* of the multiplier MP1 is input to a comparator CMPl. On the other hand, the input current Ii is detected by a resistor R4, and input to the comparator CMPl, which compares the current Ii* with the current Ii and outputs a PWM signal proportional to the difference. The PWM signal of the comparator CMPl is applied to drive the switching element SWl of the step-up chopper, thereby suppressing the high frequency and raising the power factor under a feed-forward control. Thus, the output Δ V0 is not stabilized due to the variation in the voltage ei and the load change. Therefore, the output V0 is inputted to the constant-voltage circuit, the varied components V0 of the output V0 is obtained by a constant-voltage circuit, and multiplied by the voltage ei, thereby obtaining the product of a current command value Ii*. In this manner, a feedback circuit is formed. The amplitude of the current command value Ii* is altered according to the varied component of the output V0. Thus, the output V0 is stabilized, and simultaneously the same current waveform as the voltage ei is obtained.

Since the average current at each switching is proportional to the input voltage, the harmonic wave of the switching waveform is removed by a low-pass filter of the inductor LF and the capacitor CF, and hence the input voltage becomes similar as shown in FIG. 2 in one period of the AC line, thereby obtaining the power factor of about 1.

A half bridge is connected as a load to the step-up chopper. Symbols Q2 and Q3 denote power switching elements for forming an inverter. A choke coil L2 and a fluorescent lamp FL are connected as loads in series with the inverter. The capacitor C1 has a capacity (about 1 uF) sufficient to supply energy to the step-up chopper on one period of the switch.

However, the efficiency of the fluorescent lamp lighting apparatus of the type described above becomes (the efficiency of power factor improving circuit) x (the efficiency of voltage resonance inverter). Thus, a high efficiency is scarcely obtained. The number of the components is many, and it is difficult to reduce the size and the cost.

Accordingly, an object of this invention is to provide a low-cost fluorescent lamp lighting apparatus which has a simple circuit configuration for operating an inverter and a power factor improving circuit by the same power switching element.

SUMMARY OF THE INVENTION

To solve the above-described subject, the present invention provides a fluorescent lamp circuit comprising a step-up chopper to improve a power factor having a switching circuit, a quasi E-class voltage resonance inverter connected to the step-up chopper having a switching circuit, a power switching element consisting of a single transistor which operates as the switching circuit of the step-up chopper and the switching circuit of the resonance inverter, a fluorescent lamp connected as the load of the inverter, and a stabilizer to detect a current flowing through the fluorescent lamp and controlling the interrupted frequency of the inverter according to the detection signal to stabilize the lighting current of the fluorescent lamp.

This invention also provides a control circuit for controlling a voltage applied to a power switch element at a predetermined voltage when the fluorescent lamp is not lit immediately after a power source is turned on. This invention further provides a control circuit for stopping an output when the fluorescent lamp is not connected. In addition, this invention provides a control circuit for stopping an output when an overcurrent flows through the fluorescent lamp.

This invention commonly uses the power switching element for the power factor improving circuit and a quasi E class voltage resonance inverter, and controls the turn-ON and turn-OFF of the power switching element by the single frequency modulation type control circuit.

DESCRIPTION OF THE PREFERRED EMBODIMENTS

An embodiment of this invention will be described with reference to the accompanying drawings.

Figure 1:
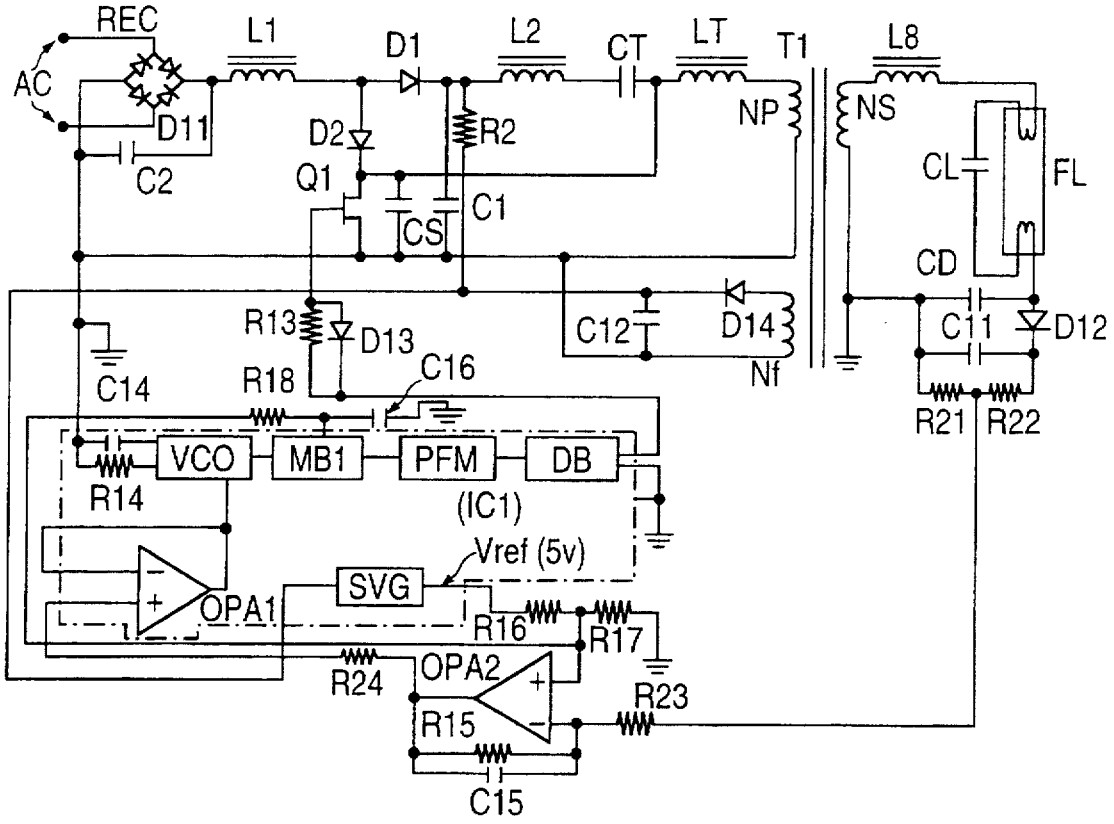
FIG. 1 is a circuit diagram showing an embodiment of this invention.
Figure 2:
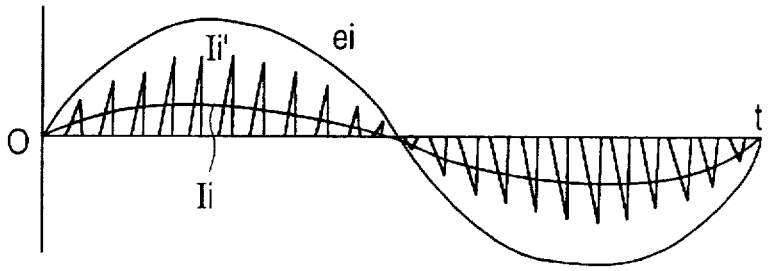
FIG. 2 is a waveform diagram for describing the operation of a quasi E class voltage resonance inverter.

FIG. 1 is a circuit diagram showing a fluorescent lamp lighting apparatus of this invention. In FIG. 1, symbol T1 denotes a step-up transformer having a primary coil NP, a secondary coil NS and a feedback coil Nf of a quasi E class voltage resonance inverter. Symbol IC1 designates a control circuit for a voltage resonance switching power source, which is formed of an integrated circuit. Symbol Q1 is a power switching element (POWER MOS FET). A resistor R2 is a starting resistor, which operates to turn ON a power source, which supplies power to a resonance type switching power source control circuit IC1 to operate the control circuit IC1. The control circuit IC1 includes a voltage-controlled oscillator VCO, a one-shot multivibrator MBI, a pulse frequency modulator PFM, a driver DB, an error amplifier OPAI, and a reference voltage generator SVG for generating a reference voltage Vref of 5 V.

The AC voltage of a commercial power source AC is full-wave rectified by a bridge rectifier REC to become the input voltage of a power factor improving step-up chopper. The step-up chopper includes a choke coil L1, a diode D1, a capacitor C1, and the power switching element Q1. A quasi E class resonance inverter is connected as a load to the step-up chopper. The inverter includes a step-up transformer Tl together with the power switching element Q1, inductors L2 and LT, and capacitors CS and CT. A fluorescent lamp FL, a choke coil LB and a lamp current detecting capacitor CD are connected in series with the secondary coil NS of the step-up transformer T1.

The operation of the embodiment of this invention will be described. First, the fundamental operation of the circuit will be described.

Figure 3:
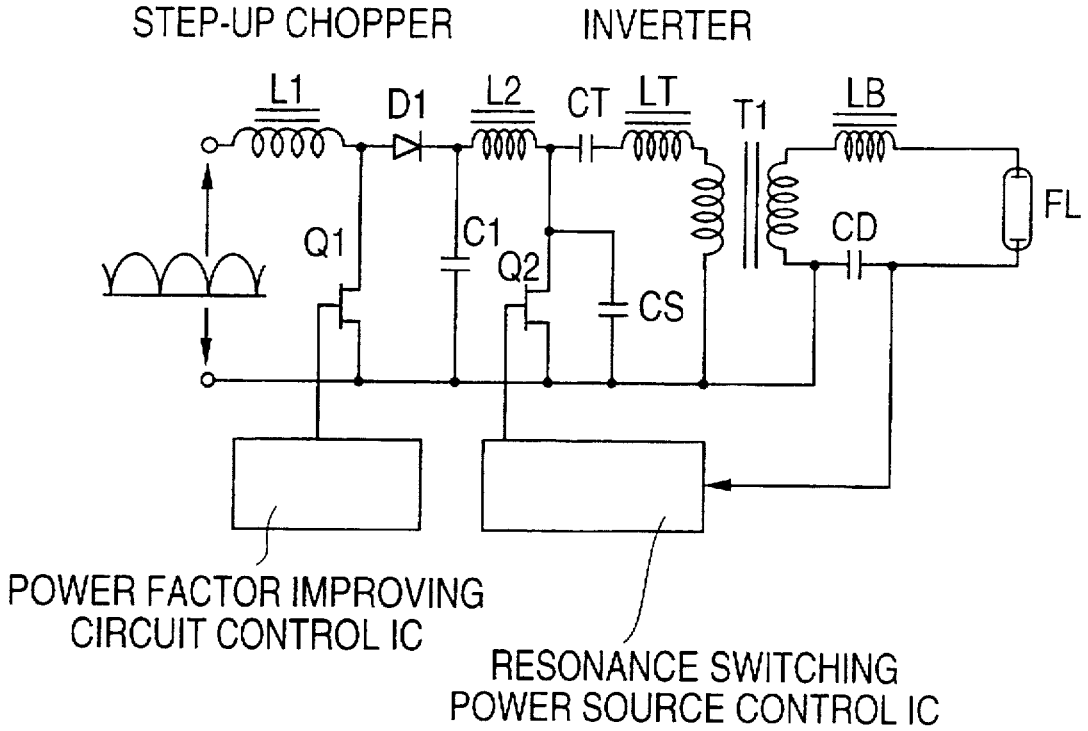
FIG. 3 is a circuit diagram for describing the operations of a chopper and an inverter.

FIG. 3 is a fundamental circuit of the fluorescent lamp lighting apparatus having a power factor improving step-up chopper and a quasi E class resonance inverter. The power factor improving step-up chopper includes a power switching element Q1, a diode D1, a choke coil L1 and a capacitor C1. The step-up chopper is switched by the input from the power switching element Q1 full-wave rectified from the AC voltage of the commercial AC power source, and the output of the step-up chopper is applied to the inverter. The switching operation of the power switching element Q1 is controlled by the power factor improving circuit control IC. The current flowing in the choke coil LQ is similar to the input voltage, thereby obtaining a high power factor.

The quasi E class voltage resonance inverter includes a power switching element Q2, capacitors CT and CS, an inductor LT and a step-up transformer Tl. A ballast choke coil LB and the fluorescent lamp FL are connected in series with the secondary side of the step-up transformer Tl. The lamp current is detected by a lamp current detecting capacitor CD, and controlled to be constant by controlling the switching frequency.

Figure 4:
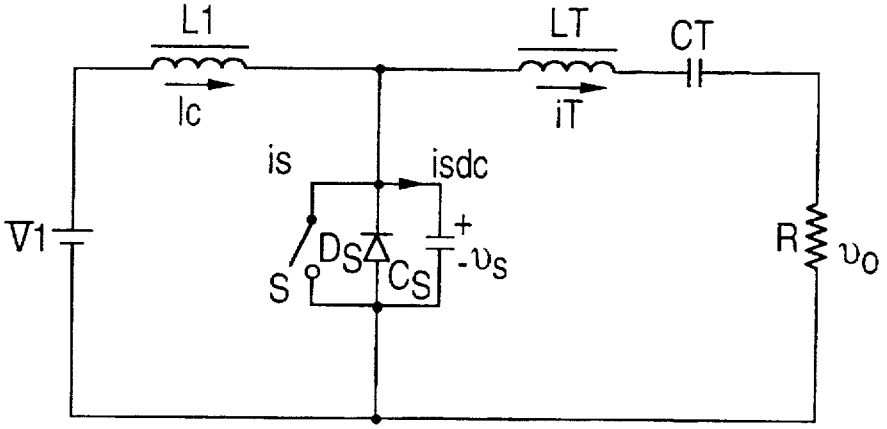
FIG. 4 is a circuit diagram for describing the operation of a pseudo E class voltage resonance inverter.

FIG. 4 is a fundamental equivalent circuit of the quasi class E voltage resonance inverter. In FIG. 4, the current flowing to a switch S and a voltage applied to the switch S are parts of a sine wave. The inverter is known as an inverter for outputting a sine wave. The operational principle of this circuit will be simply described.

In FIG. 4, a reactor L1 is a choke coil. The current flowing through the reactor L1 similarly becomes a direct current IC. An inductor LT and a capacitor CT form a resonance circuit. A resistor R also include a part of the resonance circuit. A pulse like voltage is applied to an RLC tuning circuit by the ON and OFF operations of the switch S. If the switching frequency is slightly higher than the resonance frequency F obtained by the following formula, $$F=1/(2\pi\sqrt{LT\times CT})$$

the current flowing through the resistor R, the inductor LT and the capacitor CT of the tuning circuit similarly becomes a sine wave. In this case, the RLC tuning circuit has an inductive reactance. Thus, the current iT flowing through the tuning circuit is delayed in phase from the voltage applied to the tuning circuit, i.e., the fundamental wave of the voltage VS of the switch.

Figure 5:
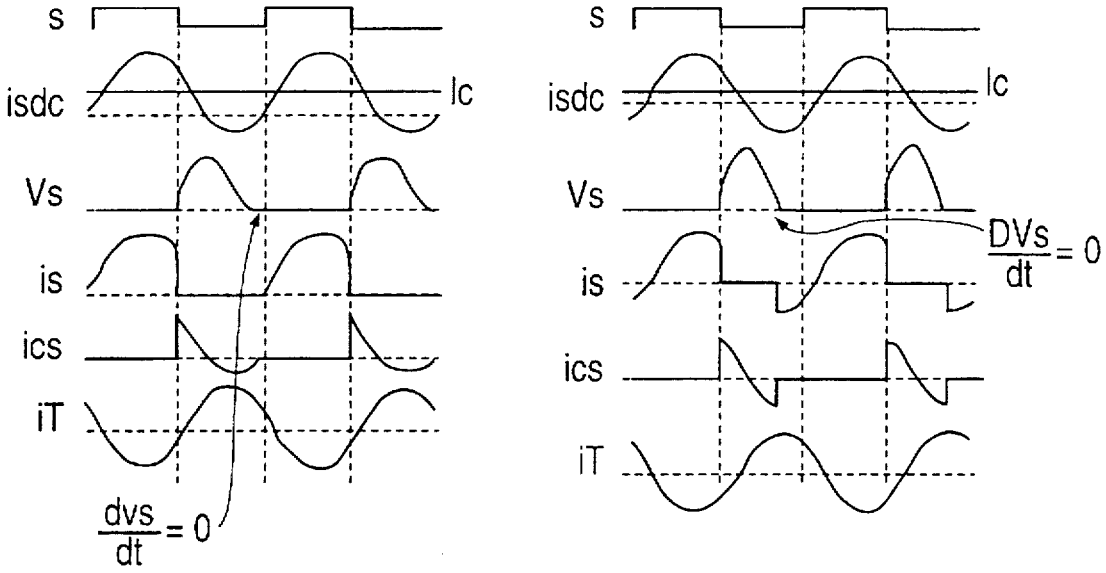
FIG. 5 is a waveform diagram for sections of the circuit of the pseudo E class voltage resonance inverter.

In this case, there exists Ic=Isdc+iT. Therefore, the difference obtained by subtracting the sine wave current iT from the DC current Ic becomes the current Isdc flowing through a parallel circuit of the switch S, the diode DS and the capacitor CS, which is also a sine wave. FIG. 5(*a*) shows the operating waveform of the E class resonance inverter when the duty of the switch S is 50%. When the switch S is opened, the sine wave current flowing through the capacitor CS, which is charged by the current ics, and the voltage VS is raised from zero in a sine wave state. Thus, the switch S is switched to be opened with zero voltage and non-zero current. As shown in FIG. 5(*a*), the voltage Vs of the switch S is dropped to zero at a gradient dvs/dt near zero at the optimum load Ropt, and the switch S is closed when Vs =0 and dvs/dt=0 are obtained.

When the load resistor R is smaller than the optimum resistance value, as shown in FIG. 5(*b*), the voltage Vs of the switch S is dropped to zero at a large gradient Vs/dt, and parallel backward diode DS is turned ON. The voltage VS of the switch S is clamped to zero voltage, and the switch S is closed during this period. This is the quasi E class operation, and switched to zero voltage similarly to the voltage resonance switch. When it is operated as a switching regulator, the E class operation cannot be executed in the entire variable range of the load and the input voltage, and some range is obtained the quasi E class operation. Since the impedance of the RLC tuning circuit is sensitive with the switching frequency, when the output voltage V0 or the output current iT is controlled by the switching frequency modulation, it has the advantage that the change of the switching frequency is small.

In the circuit of FIG. 3, two power switching elements are required, and respectively need control ICs, and hence its high efficiency is scarcely obtained, and the number of components is increased. Therefore, a circuit in which one power switching element is reduced Is shown in FIG. 6.

Figure 6:
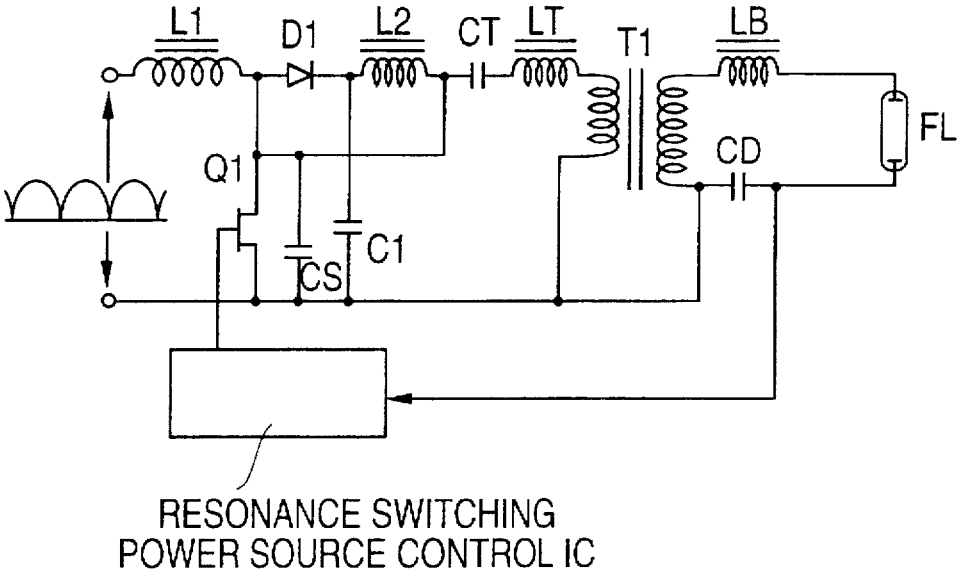
FIG. 6 is a circuit diagram for describing the operation of an embodiment of this invention.

In the circuit of FIG. 6, the power switching element Q1 is common for the power factor improving step-up chopper and the quasi E class voltage resonance inverter. Since the peak value of the current flowing to the choke coil L1 is substantially proportional to the input voltage, it becomes similar to the input voltage by removing the harmonic waves due to the switching. The lamp current is detected by the lamp current detecting capacitor CD, and the switching frequency is controlled thereby to control the lamp current constantly similarly to the circuit of FIG. 3.

The operation of the embodiment of this invention will be described. In the circuit in FIG. 1, at the initial time when the power is supplied from the power source to the bridge rectifier REC, the fluorescent lamp FL is not lit, and no current flows to the fluorescent lamp FL. Accordingly, the voltage across the current detecting capacitor CD is 0 V. When the fluorescent lamp FL Is lit at the time of the normal operation, the voltage is generated across the current detecting capacitor CD, rectified and smoothed by the voltage diode D12 and the capacitor C11, voltage-divided by the resistors R21 and R22, and input to the inverting input terminal of an operational amplifier OPA 2. At present, since the voltage across the current detecting capacitor CD is zero, the voltage of the inverting input terminal of the operational amplifier OPA2 is 0 V. Therefore, the output of the operational amplifier OPA2 is a high level, and hence the voltage of the control input terminal of the control IC is also a high level. The resonance switching power source control circuit IC1 executes a so-called pulse frequency modulation (PFM) in which the control circuit IC1 becomes a high oscillation frequency when the voltage of the control input terminal of the control circuit IC1 becomes low, whereas, the oscillation frequency becomes low when the voltage of the control input terminal of the control circuit IC1 becomes high. Accordingly, the oscillation frequency of the voltage-controlled oscillator VCO is lowered as compared with that at the time of normal operation in which the current flows to the fluorescent lamp FL. Hence, since the primary current of the step-up transformer T1 is increased as compared with that at the time of the normal operation, the output voltage is raised. When the turn ratio of the step-up transformer T1 is so selected that the output voltage becomes the discharge starting voltage or higher of the fluorescent lamp FL, the fluorescent lamp FL is lit.

Since the choke coil LB becomes the discharge maintaining voltage of the voltage across the fluorescent lamp FL at the time of lighting the lamp FL, the choke coil LB is a ballast inductor for sharing the difference of the output voltage of the secondary side of the step-up transformer T1 and the discharge maintaining voltage.

To constantly control the lamp current flowing through the fluorescent lamp FL, the lamp current is detected by the detecting capacitor CD, rectified and smoothed by the diode D12 and the capacitor C11, the resultant DC voltage is supplied to the control input terminal of the resonance switching power source control circuit IC1. More specifically, when the lamp current is increased due to a certain cause, the voltage across the detecting capacitor CD is raised, and hence the voltage of the control input terminal of the resonance switching power source control circuit IC1 is lowered. Accordingly, the oscillation frequency of the voltage-controlled oscillator VCO is raised, and the lamp current is reduced. The resistors R21 and R22 are for setting the lamp current. The capacitor CS constitutes a serial resonance circuit together with the inductor L2, and converts the drain voltage waveform when the power switching element Q1 is turned OFF to a sine wave state. Symbol R13 designates a gate drive resistor of the power switching element Q1, and symbol D13 denotes a stored charge extracting diode between the gate and the source of the power switching element Q1. A diode D14 and a capacitor C12 constitute the power supply rectifier of the resonance switching power source control circuit IC1.

Figure 10A:
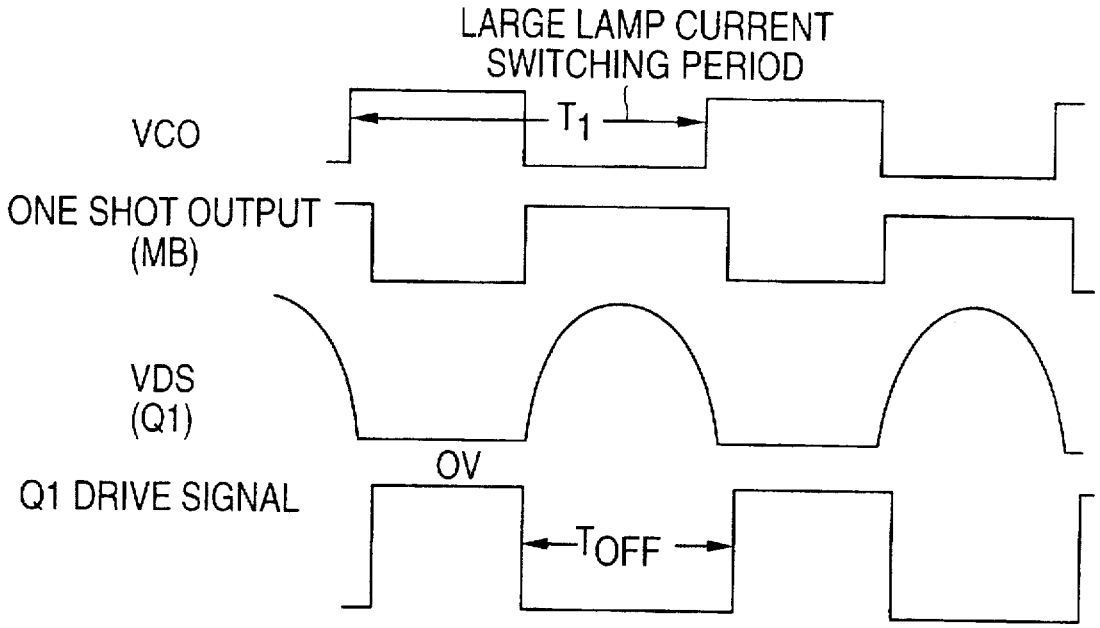
FIG. 10 is a waveform diagram of sections of a resonance switching power source control circuit.
Figure 10B:
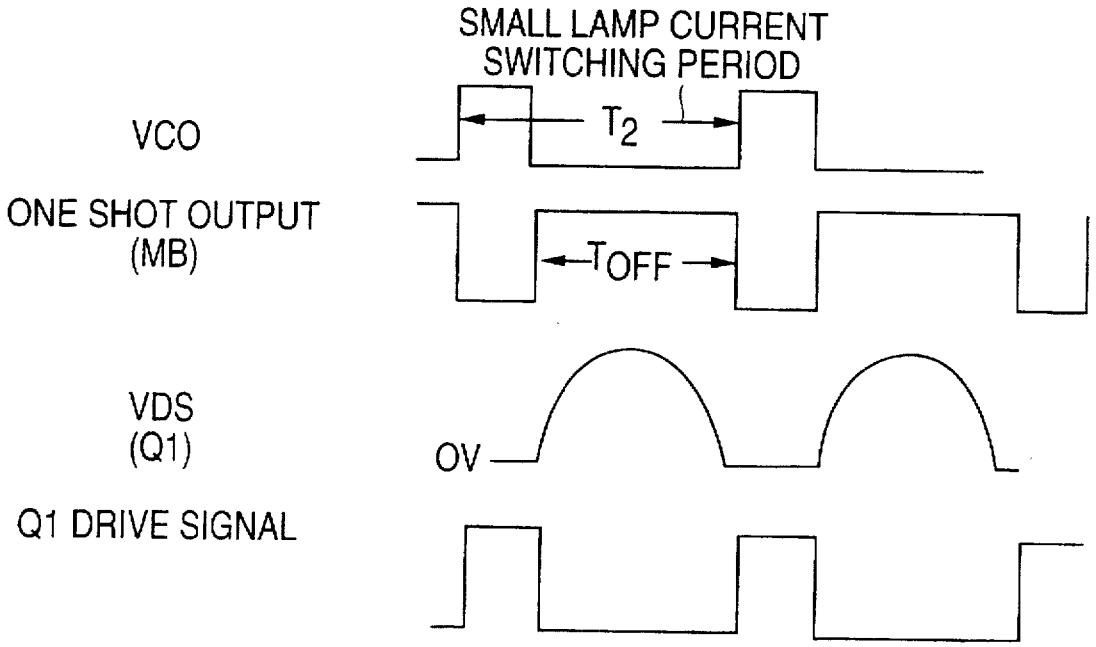

Then, the operation of the resonance switching power source control circuit IC1 will be described in detail with reference to FIGS. 1 and 10. When the lamp current is increased due to a certain cause, the voltage of the control input terminal of the control circuit IC1 is lowered, and hence the oscillation frequency of the voltage-controlled oscillator VCO is raised. The one shot of the one-shot multivibrator MB1 is set by the fall of the output of the voltage-controlled oscillator VCO, and its output becomes a high level. A resistor R18 and a capacitor C16 are for determining the output pulse width of the one shot multivibrator to hold the output of the one shot multivibrator at a high level during the period Toff determined by its time constant. The period Toff is so set by considering the dispersion of the choke coil L2 and the voltage resonance capacitor CS and the variation of the resonance frequency due to the temperature change as to satisfy the voltage resonance operation. More specifically, the period Toff is so pulse-frequency controlled as to vary the oscillating frequency (=switching frequency) of the voltage-controlled oscillator VCO while the period Toff remains constant.

A capacitor C14 and a resistor R14 are for determining the oscillation frequency of the voltage-controlled oscillator VCO. Resistors R16 and R17 are elements for DC bias of the (+) input terminal of an error amplifier OPA2. A resistor R15 and a capacitor C15 are elements for correcting the phase of the error amplifier OPA2. A diode D11 and a capacitor C2 are elements for rectifying and smoothing an AC line voltage. The capacitor C2 may have a capacity (about 1 uF) sufficient to supply energy to the step-up chopper in one period of switching.

Figure 7:
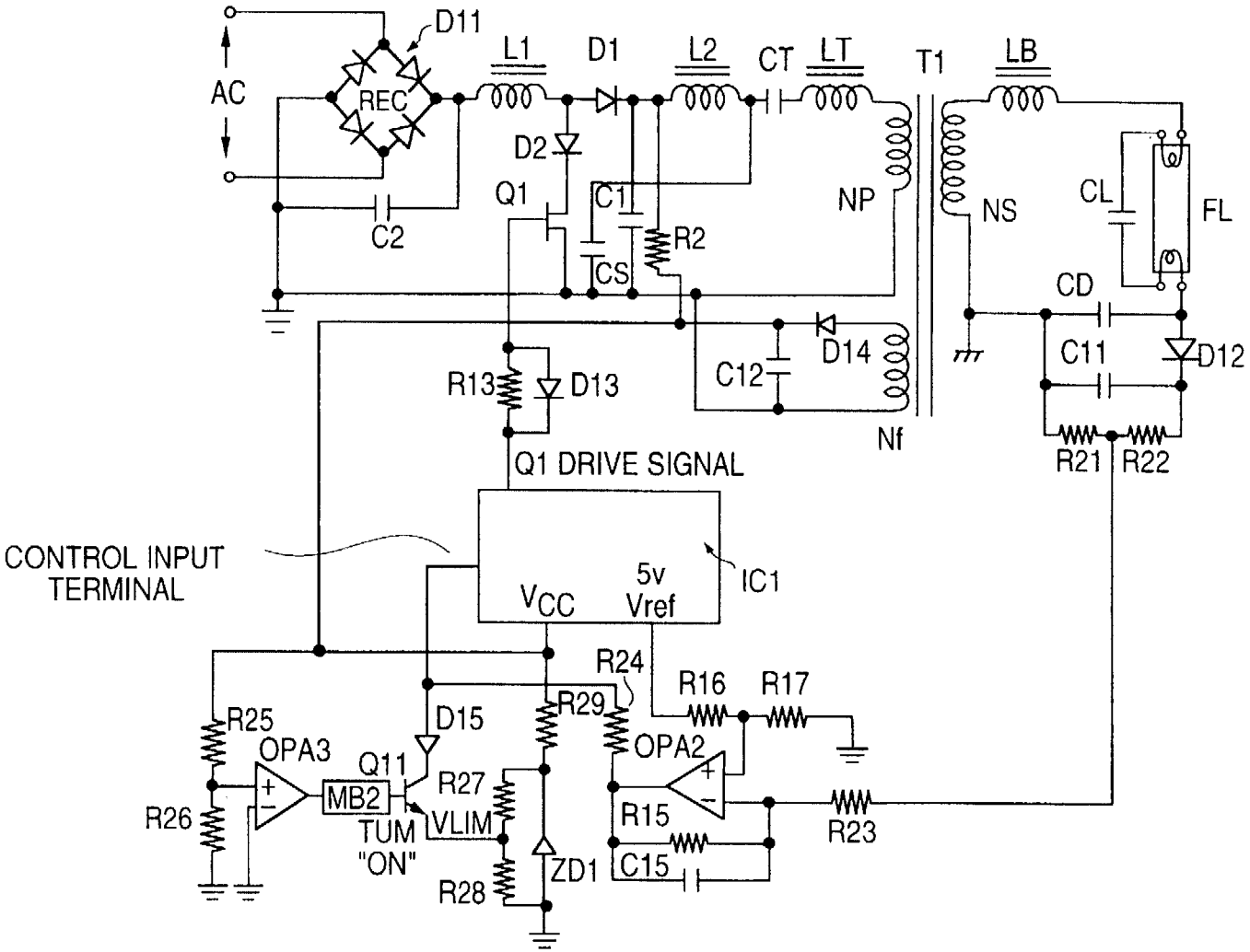
FIG. 7 is a circuit diagram showing a second embodiment of this invention.

Then, a second embodiment of this invention will be described. The circuit of the embodiment shown in FIG. 7 is substantially equal to the first embodiment shown in FIG. 1 except that a control circuit for controlling a voltage stress to be applied to a power switching element Q1 at the time of turning ON a power source is added. Symbol IC1 denotes a voltage resonance type switching power source control circuit, which has the same configuration as that shown in FIG. 1, and hence the descriptions of the detailed configuration and the operation thereof will be omitted, like reference characters designate like or corresponding parts throughout FIG. 1, and the detailed description of the entire circuit of the embodiment will be omitted.

In the circuit of FIG. 7, when the power source is turned ON, a current is supplied to resistors R25 and R26 by a starting resistor R2, the voltage of a connecting point of the resistors R25 and R26 is raised, and hence the input voltage of an operational amplifier OPA3 is raised. Accordingly, the output voltage of the operational amplifier OPA3 is raised, and a one-shot multivibrator MB2 is set. Then, the output of the one-shot multivibrator MB2 becomes a high level for a period of a predetermined time TLIM. Since a transistor Q11 is turned ON during the period of the time TLIM, the voltage of the control input terminal of the control circuit IC1 becomes substantially the same as the voltage VLIM divided by resistors R27 and R28 from the voltage of a Zener diode ZD1. Since the output voltage of a step-up chopper fixed to the oscillation frequency of the control circuit IC1 is held constant by setting the voltage VLIM to a suitable value, an excess voltage stress is not applied to the power switching element Q1.

When the time TLIM is elapsed after the power source is turned ON, the output of the one-shot multivibrator MB1 becomes a low level, and a transistor Q11 is turned ON. Accordingly, the voltage of the control input terminal of the control circuit IC1 becomes equal to the output voltage of the operational amplifier OPA2, and a lamp current is constantly controlled.

Figure 8:
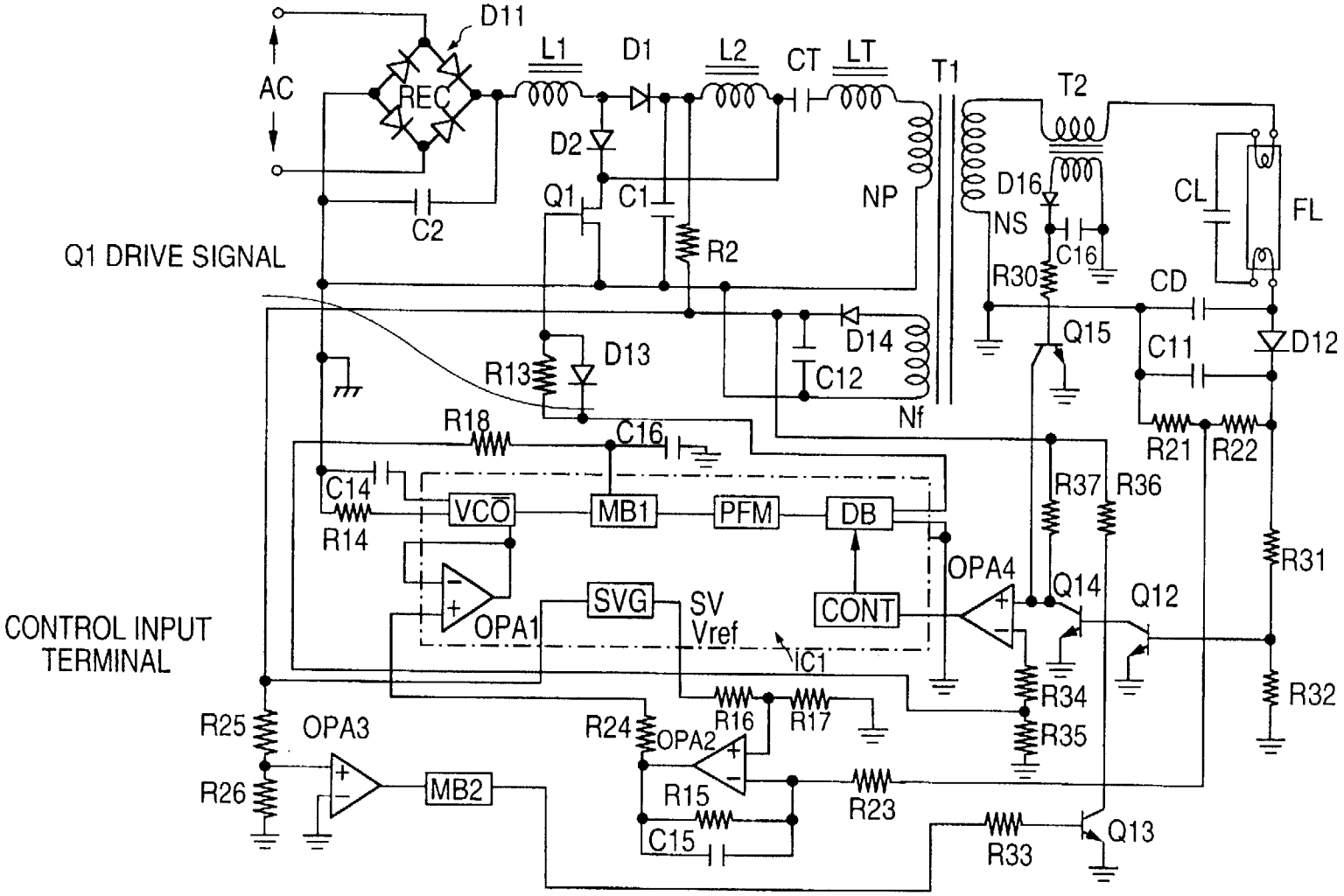
FIG. 8 is a circuit diagram showing a third embodiment of this invention.
Figure 9:
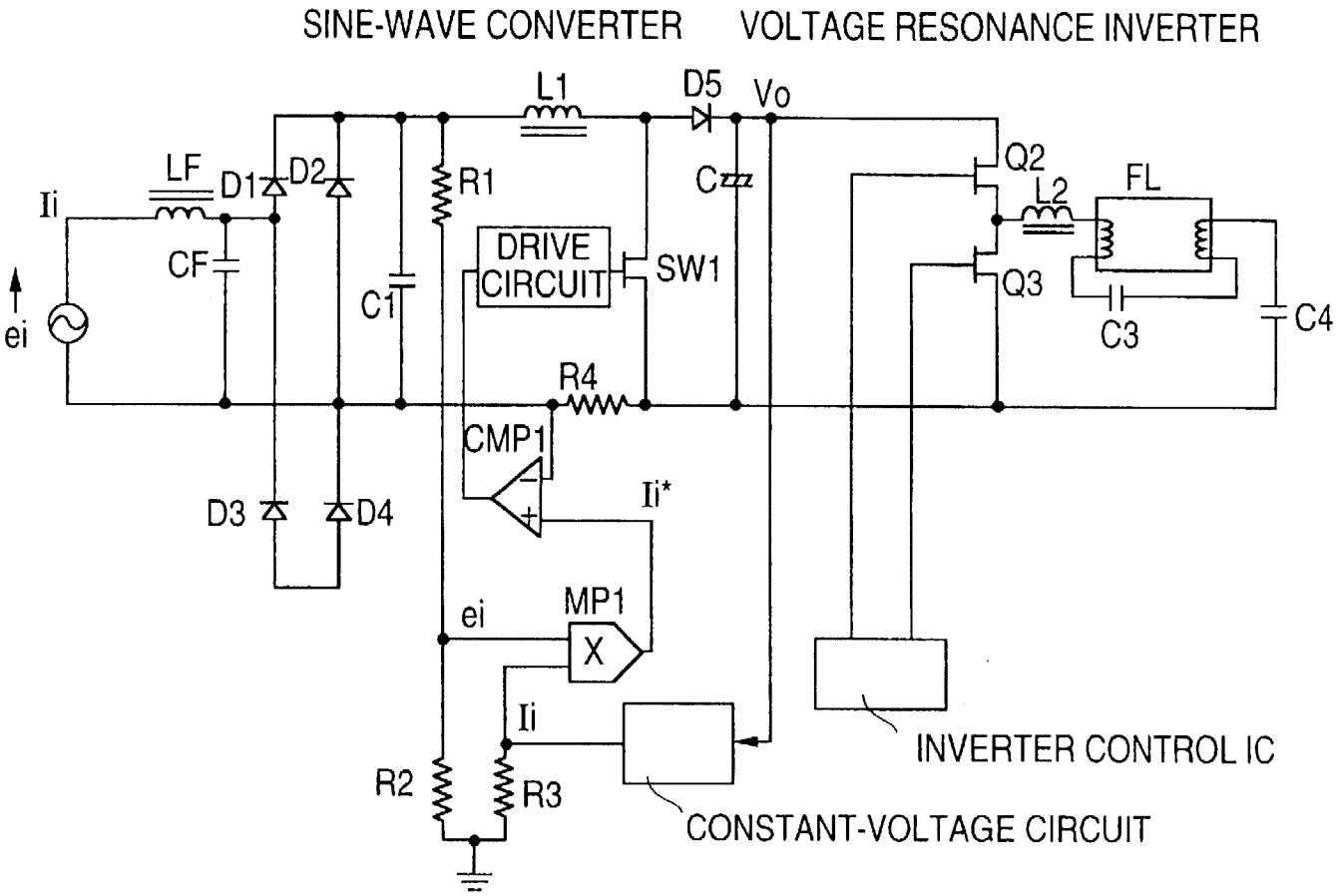
FIG. 9 (PRIOR ART)
FIG. 9 is a circuit diagram of a conventional example.

FIG. 8 is a circuit diagram showing a third embodiment of this invention. In this embodiment, a control circuit for stopping the output of a fluorescent lamp lighting apparatus when a fluorescent lamp is not yet mounted in the fluorescent lamp lighting apparatus or when an excess lamp current flows is provided. In FIG. 8, symbol CONT denotes a control circuit of a driver DB. The driver DB is operated when the input of the control circuit CONT is a high level, and the fluorescent lamp lighting apparatus of this embodiment generates an output. Contrary, when the input of the control circuit CONT is a low level, the driver DB is not operated, and the output of the fluorescent lamp lighting apparatus of this embodiment is stopped.

When the power source is turned ON, a current is supplied to resistors R25 and R26 by a starting resistor R2, and hence the voltage of the connecting point of the resistors R25 and R26 is raised. Therefore, the output voltage of an operational amplifier OPA3 is raised, a one-shot multivibrator MB2 is set, and the output of the multivibrator MB2 becomes a high level for a period of a predetermined time TLIM. Thus, a transistor Q13 is turned ON, and a transistor Q14 is turned OFF. Accordingly, the collector voltage of the transistor Q14 becomes a high level, and the input of the control circuit CONT becomes a high level, and hence the driver DB is operated.

When the time TLIM is elapsed after the power source is turned ON, the output of the one-shot multivibrator MB2 becomes a low level, and hence the transistor Q13 is turned OFF. On the other hand, when a fluorescent lamp is mounted in the fluorescent lamp lighting apparatus of this embodiment, a lamp current flows, and hence a voltage is generated across a lamp current detecting capacitor CD. This voltage is rectified and smoothed by a diode D12 and a capacitor C11, divided by resistors R31 and R32, and then input to the base of the transistor Q12. Therefore, the transistor Q12 is turned ON, and the transistor Q14 is turned OFF. Hence, since the input of the control circuit CONT becomes a high level, the driver DB is operated.

When a fluorescent lamp is not yet mounted in the fluorescent lamp lighting apparatus of this embodiment, no lamp current flows, a voltage across the lamp current detecting capacitor CD is 0 V, and hence the transistor Q12 is turned OFF. When a time TLIM is elapsed after the power source is turned on, the transistor Q12 is turned OFF. Accordingly, the input voltage of an operational amplifier OPA4 for turning ON the transistor Q14 becomes a low level, and hence the input of the control circuit CONT becomes a low level. Therefore, the driver DB is not operated, and hence the output of the fluorescent lamp lighting apparatus of this embodiment is not generated.

When an excess lamp current flows, a large voltage is generated in the secondary winding of a transformer T2, this large voltage is rectified and smoothed by a diode D16 and a capacitor C16, and input to the base of a transistor Q15 through a resistor R30, and hence the transistor Q15 is turned ON. When the turn ratio of the transformer T2 and the resistance of the resistor R30 are set to suitable values, the transistor Q15 is turned OFF when a normal lamp current flows in the fluorescent lamp lighting apparatus of this embodiment. When an excess lamp current flows and the transistor Q15 is turned ON, the input voltage of an operational amplifier OPA4 becomes a low level, and hence the input of the control circuit CONT becomes a low level. Therefore, the driver D3 is stopped, and the output of the fluorescent lamp lighting apparatus is also stopped.

According to this invention, the power switching element is shared for the inverter and the power factor improving circuit. Accordingly, the number of the power switching elements can be reduced by one, and hence the efficiency of the fluorescent lamp lighting apparatus of the invention can be improved. Further, the number of the components can be reduced, and the size and the cost of the fluorescent lamp lighting apparatus of the invention can be reduced.

What is claimed is:

1. A fluorescent lamp circuit comprising:

a step-up chopper to improve a power factor and having a first switching circuit;

a quasi E-class voltage resonance inverter connected to the step-up chopper, having a second switching circuit;

a power switching element consisting of a single transistor operated as the first switching circuit and the second switching circuit;

a fluorescent lamp connected as the load of the inverter; and a stabilizer to detect a current flowing through said fluorescent lamp and to control an interrupted frequency of the inverter according to a detecting signal to stabilize the lighting current of the fluorescent lamp.

2. A fluorescent lamp circuit according to claim 1, further comprising a control circuit to control a voltage applied to the power switch element at a predetermined voltage when the fluorescent lamp is not lit immediately after a power source is turned on.

3. A fluorescent lamp circuit according to claim 1, further comprising a control circuit to stop an output when the fluorescent lamp is not connected.

4. A fluorescent lamp circuit according to claim 1, further comprising a control circuit for stopping an output when an over-current flows through said fluorescent lamp.

* * * * *

UNITED STATES PATENT AND TRADEMARK OFFICE

CERTIFICATE OF CORRECTION

PATENT NO. : 5,798,616
DATED : August 25, 1998
INVENTOR(S) : TAKEHARA, et al.

It is certified that error appears in the above-identified patent and that said Letters Patent is hereby corrected as shown below:

Column 1, line 19, change "Sw1" to --SW1--;
line 37, delete "Δ"; and
line 40, change "V0" (first occurence) to --ΔV0--.

Column 4, line 40, change "Is" to --is--;
line 56, change "0 V" to --0V--; and
line 65, change "0 V" to --0V--.

Column 7, line 23, change "0 V" to --0V--.

Column 8, line 3, change "D3" to --DB--.

Signed and Sealed this

Sixteenth Day of March, 1999

*Attest:*

Q. TODD DICKINSON

*Attesting Officer*

*Acting Commissioner of Patents and Trademarks*